United States Patent [19]

Earley

[11] 4,019,557

[45] Apr. 26, 1977

[54] EMERGENCY TEMPORARY DOOR COVER

[76] Inventor: John J. Earley, P.O. Box 196, 207 McKinley Ave., Lansdowne, Pa. 19050

[22] Filed: Aug. 22, 1975

[21] Appl. No.: 606,749

[52] U.S. Cl. ..... 160/354; 160/368 S

[51] Int. Cl.[2] ..... A47H 33/00

[58] Field of Search ..... 160/354, 368, 368 S, 160/369, DIG. 2, DIG. 3; 49/466, 465, 463, 62

[56] References Cited

UNITED STATES PATENTS

| | | | |
|---|---|---|---|
| 2,491,574 | 12/1949 | Morgan | 160/DIG. 2 UX |
| 2,614,630 | 10/1952 | Moszelt | 160/DIG. 3 UX |
| 2,665,754 | 1/1954 | Claussen et al. | 160/268 S X |
| 3,123,394 | 3/1964 | Corsetti | 160/368 S X |
| 3,411,562 | 11/1968 | Garrett | 160/368 S X |

*Primary Examiner*—Philip C. Kannan

*Attorney, Agent, or Firm*—Smith, Harding, Earley & Follmer

[57] ABSTRACT

An emergency temporary door cover for covering a broken glass door pane until the broken glass can be replaced, comprising a cover sheet which is foldable for easy storage when not in use, a hook extending from the top of the sheet for suspending the sheet from the top of the door, upper and lower straps extending from the sides of the sheet, and bendable wire supported by the straps and adapted to take a set, so that the installer may hook the sheet to the top of the door and bend the wire around the side edges of the door to hold the cover sheet in place, and may do so while standing in front of the door. Then the installer walks to the rear of the door while the hook and side wires hold the cover in place, and ties the straps across the rear of the door to secure the cover to the door until the broken pane can be replaced.

7 Claims, 8 Drawing Figures

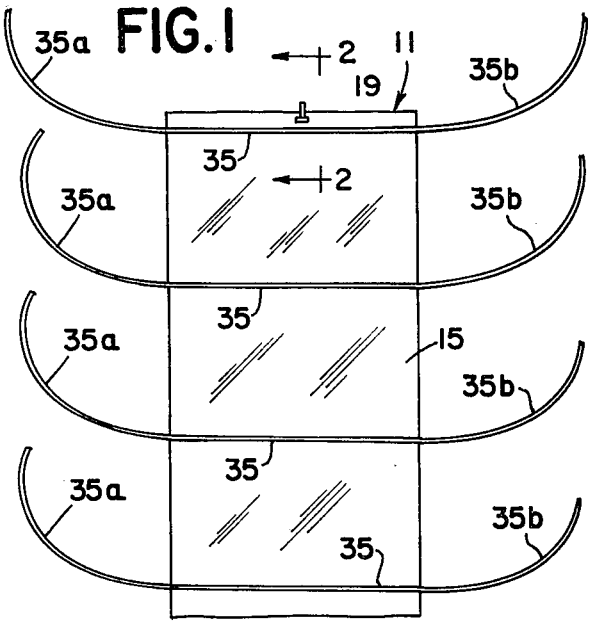
FIG. 1
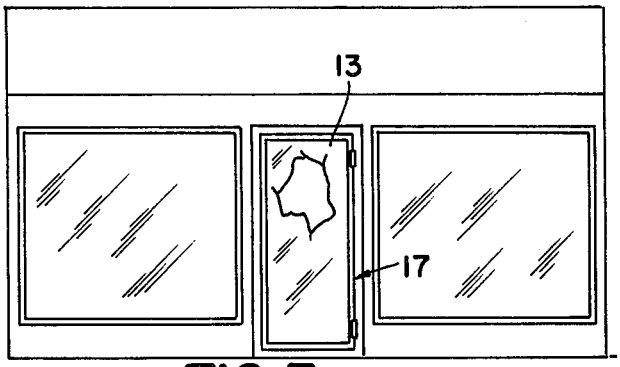
FIG. 3
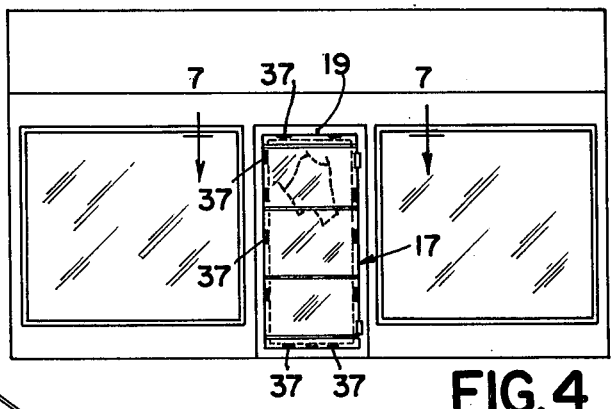
FIG. 4
FIG. 2
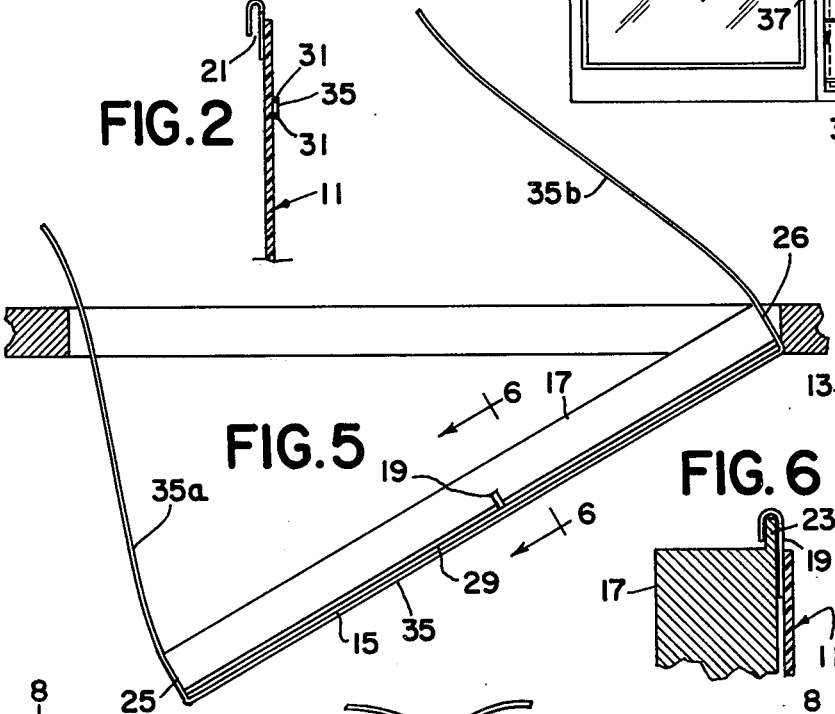
FIG. 5
FIG. 6
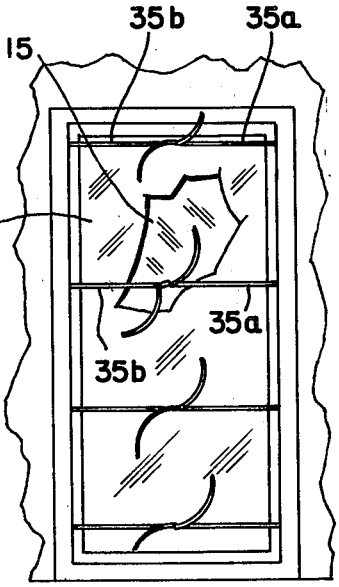
FIG. 8
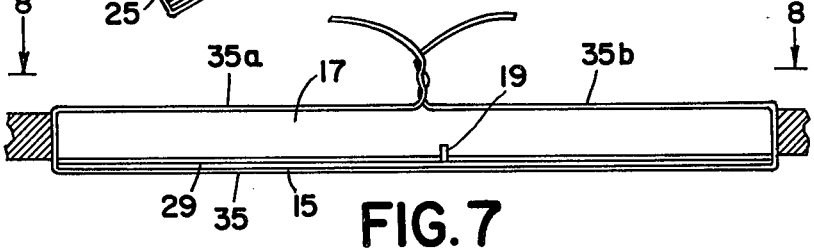
FIG. 7

EMERGENCY TEMPORARY DOOR COVER

BACKGROUND OF THE INVENTION

If the pane of a glass door is broken, as by a burglar, or by the wind, or by a grocery cart, or by a delivery man, in a store such as in a supermarket grocery store, the store manager must telephone for a glass emergency service and ask for a service man to come and temporarily board up his door with plywood so as to protect the store against any illegal entry and theft. Also, in the daytime when the store is open, the broken door must be boarded up in order to protect the occupants of the store against the cold in cold weather, and against the heat in hot weather if the store is air conditioned. The door is boarded up until a glass pane installer can arrive and measure the size of the door pane area, procure a replacement glass panel, and install it.

There may be a wait of several hours after the glass door pane has been broken before an emergency service man can arrive at the scene and board up the door. In the meantime, for example, if someone has pushed a grocery cart through the front door of a supermarket in cold weather, the checkout clerks are freezing, the customers are cold, and everyone is unhappy.

The problem has become worse since the passage by most states of laws requiring that the panels of doors be made of tempered glass instead of plain sheet glass. This is a safety measure designed to protect the public against injuries caused by the breaking of plain glass which breaks up into large sheets that can cut and seriously injure people. Panes made of tempered glass shatter into small pieces that do not cut.

However, this safety measure poses a serious problem for the emergency glass replacement installer. With glass panes, the installer could carry a number of sheets of plain sheet glass and then cut them down to size to fit the door panel area. However, tempered glass door panels cannot be cut to size by the installer in the field. Instead, the installer must measure the pane area of the door, board it up, and then go back to the shop to select a tempered glass sheet of the correct size for installation in the pane area of the door.

SUMMARY OF THE INVENTION

To solve these problems, to prevent the occupants of a store from freezing or from being uncomfortably hot while they await the arrival of an emergency installer to board up the pane area of a broken door, to prevent illegal entry through the broken door, and to avoid the boarding up the door and its cost, this invention provides an emergency temporary door cover which is immediately available and which is easily installed by store personnel or anyone else, and does not require any special skills, tools, strength, or experience to install.

The invention provides a emergency temporary door cover that is foldable and is easily stored in a small space, and which may be suspended from the top of the door and temporarily held at the sides of the door while its installer is operating from the front of the door. Then the installer may release the emergency door entirely, walk around to the rear of the door while the emergency cover remains securely in place, and fasten the door cover to the door from the rear, whereupon the door cover is completely installed, and the door cover installer may resume his usual duties.

BRIEF DESCRIPTION OF THE DRAWINGS

FIG. 1 is a front view in elevation of an emergency temporary door cover constructed in accordance with this invention;

FIG. 2 is a partial view in section taken as indicated by the lines and arrows 2—2 which appear in FIG. 1;

FIG. 3 is a view in elevation of a store front showing a broken door pane;

FIG. 4 is a view in elevation of the store front of FIG. 3, but with the emergency temporary door cover installed;

FIG. 5 shows a view in top plan and illustrates the first step in the operation of installing the emergency temporary door cover;

FIG. 6 is a view in section taken as indicated by the lines and arrows 6—6 in FIG. 5;

FIG. 7 is a view in top plan taken as indicated by the lines and arrows 7—7 which appear in FIG. 4, and shows the emergency temporary door cover with the door closed; and FIG. 8 is a view in elevation of the rear of the door, taken as indicated by the lines and arrows 8—8 which appear in FIG. 7, with the emergency temporary door cover installed.

DESCRIPTION OF THE PREFERRED EMBODIMENTS

Turning now to the preferred embodiments of the invention selected for illustration in the drawings, there is shown an emergency temporary door cover 11 for covering a broken glass door pane 13 until the broken glass pane 13 can be replaced, comprising a cover sheet 15 of synthetic plastic large enough to cover the pane area of the door 17, with sheet 15 being foldable for easy storage when not being used to cover a door pane area. Suspension means comprising a bendable metal hook 19 extends from the top of sheet 15 for suspending sheet 15 from the top of door 17. Hook 19 is provided with a bight 21 slightly larger than the thickness of a conventional aluminum door front panel 23 onto which it hooks. Being made of bendable metal, the hook 19 is easily bent with the fingers so as to secure a firm grip on the top of front panel 23.

Grasping means extend outwardly from the sides of cover sheet 15 for grasping the side edges 25-26 of the door 17 to spread the sheet 15 laterally and hold it temporarily in place against the front 29 of the door 17 until the installer can fasten sheet 15 to the door. The grasping means are nonresilient wires 31 bendable into a set position for grasping the side edges 25, 26 of the door 17.

Fastening means extend from the sides of the cover sheet 15 and are held by the grasping means or wires 31 across the rear 33 of the door 17 until the installer can reach the fastening means and tie them together. The fastening means are a series of straps 35 having oppositely extending ends **35*a*, 35*b* adapted to be tied together. The straps 35 are adhesively mounted on the front of cover sheet 15 and may be made of synthetic plastic with the wires 31 molded therein and supported by the straps 35**.

The emergency method, in accordance with this invention, of covering a door 17 having a broken glass pane 13 with a temporary cover 11 until the broken glass pane 13 can be replaced, said cover 11 comprising a cover sheet 15 of synthetic plastic large enough to cover the pane area of the door 17, said cover sheet 15 being foldable for easy storage when not being used to cover a door pane area, a metal hook 19 extending from the top of the cover sheet 15 and having a bight 21 slightly larger than the thickness of an aluminum door front panel 23, hook 19 being located one inch from the center line of sheet 15 so that the sheet may be folded easily along its center line for storage, a series of straps 35 having ends 35*a* and 35*b* extending from opposite sides of the door cover 15 and adapted to be tied together, and wires 31 supported in the straps 35 and bendable into a set position for grasping the side edges 25, 26 of the door 17 so as to spread the cover sheet 15 laterally and position the straps 35 at the rear of the door 17, the steps comprising taking the emergency door cover 11 from storage, unfolding it, placing the hook 19 over the top of the front door panel 23 so as to suspend the cover sheet 15 from the door 17, bending the wires 31 around the side edges 25, 26 of the door 17 so as to stretch the cover sheet 15 laterally and hold it in place and so as to position the straps 35 at the rear 33 of the door 17 in position for tying, walking from the front 29 of the door 17 to a position at the rear 33 of the door 17, and tying the ends of the straps 35 together, which straps 35 having been held in position for tying by the wires 31. The edges of cover sheet 15 may then be fastened to the door by applying self-fastening labels 37 or by applying masking tape.

Top strap 35 is preferably positioned about 2 inches from the top of sheet 15 so that the top edges of sheet 15 do not droop objectionably.

OPERATION

The installing of the emergency temporary door cover 11 is simple and is easily accomplished. The installer, who may be anyone since no special installation skills or experience are required, takes the emergency door cover 11 from storage, unfolds it, opens the door, and places the hook 19 over the top center of the front panel 23 of the door 17 so as to suspend the cover sheet 15 from the door 17. The bight 21 of the hook 19 is about one-quarter inch wide and fits snugly over the top of the one-quarter inch thick front door panel 23 of the standard aluminum door. The hook 19 is made of sheet metal and is bendable by the fingers so as to accommodate any variation in thickness of front door panel 23.

Then the installer bends the metal wires 31 around the side edges of the door 17 so as to spread the cover sheet 15 laterally and hold it in place by grasping the edges 25, 26 of the door 17. Having accomplished this, he walks from the front of door 17 to the rear 33 and picks up the ends of the straps 35*a*, 35*b*, which are being held in position there by the wires 31, and ties the strap ends 35*a*, 35*b* together by pulling the strap ends tightly together and twisting then several times until firmly in place. The installer may then fasten the edges of cover sheet 15 to door 17 by applying self-fastening labels 37 between sheet 15 and door 17, or by applying masking tape. This provides additional security on windy and cold days. The installation of the emergency temporary door cover 11 is finished, the door 17 is covered until the glass pane installer can arrive, measure the door pane area, go back to his shop, procure a tempered glass pane of suitable size, return to the store, and replace the broken pane 13. Then the emergency door cover 11 is removed, folded, and returned to its storage area where it remains available for reuse should the emergency situation again occur.

Material for cover sheet 15 may be polyethylene synthetic plastic, and the preferred thickness of the plastic cover sheet 15 is 0.003 inches. The preferred standard size of the sheet 15 is 35 inches by 82 inches, which fits the standard size aluminum door of 3 feet by 7 feet.

The emergency temporary door cover 11 of the present invention is readily available and easily installed in an emergency. It is safer than the conventional boarding up the door with plywood because the cover sheet 15 is transparent and you can see though it to observe a person approaching from the other side and don't accidentally bang the door into him.

The emergency temporary door cover 11 is an energy saver because it prevents heat or air-conditioned air from escaping from the inside of the door 17. Also, it may be left on during the installation of the replacement glass pane so that the interior of the store, and the installer, are protected from the wind and cold in cold weather and from the heat in hot weather. The cover 11 does not interfere with the operation of the door 17 in any way.

It is to be understood that the form of the invention herein shown and described is to be taken as a preferred embodiment. Various changes may be made in the shape, size and arrangement of parts. For example, equivalent elements may be substituted for those illustrated and described herein, parts may be reversed, and certain features of the invention may be utilized independently of the use of other features, all without departing from the spirit or scope of the invention as defined in the subjoined claims. The term "glass" as used herein to refer to a glass pane, includes panes made from plain glass, and tempered glass. Also, the emergency temporary door cover 11 may be placed over the rear 33 of door 17 if that were desired.

In order to comply with fire laws, exit doors are required to open outwardly. When doors are boarded up with plywood, a person exiting from a store is not able to see an approaching child or pregnant woman and may accidentally shove the door forceably into such persons and cause injury. The emergency temporary door cover of this invention prevents such accidents because it is transparent, just as is the glass door pane, and enables persons exiting from the store to see people approaching the door.

I claim:

1. An emergency temporary door cover for covering a broken glass door pane until the broken glass pane can be replaced comprising a cover sheet large enough to cover the pane area of a door, said sheet being foldable for easy storage when not being used to a cover a door pane area, suspension means extending from the top of the sheet for suspending the sheet from the top of the door, and grasping means extending outwardly from the sides of the sheet for grasping the side edges of the door to spread the sheet laterally and hold it temporarily in place against the front of the door until the sheet can be fastened to the door, said suspension and grasping means being operable from the front of the door, said grasping means being permanently attached to said sheet, and fastening means for fastening the cover sheet to the door and extending from the sides of the sheet and held by the grasping means across the rear of the door until an installer can operate the fastening means.

2. The emergency door cover of claim 1, said sheet being made of polyethylene synthetic plastic.

3. The emergency door cover of claim 1, said suspension means being a metal hook which hooks onto an aluminum door front panel, said hook having a bight slightly larger than the thickness of the aluminum door front panel.

4. The emergency door cover of claim 1, said fastening means being a series of straps with oppositely extending ends adapted to be wrapped around the door and tied together.

5. An emergency temporary door cover for covering a broken glass door pane until the broken glass pane can be replaced comprising a cover sheet large enough to cover the pane area of a door, said sheet being foldable for easy storage when not being used to cover a door pane area, suspension means extending from the top of the sheet for suspending the sheet from the top of the door, and grasping means extending outwardly from the sides of the sheet for grasping the side edges of the door to spread the sheet laterally and hold it temporarily in place against the front of the door until the sheet can be fastened to the door, said suspension and grasping means being operable from the front of the door, said fastening means being a series of straps with oppositely extending ends adapted to be wrapped around the door and tied together, said grasping means being attached to said straps, said grasping means being made of non-resilient material bendable into a set position for the grasping of the side edges of the door until the fastening straps can be tied together.

6. An emergency temporary door cover for covering a broken glass door pane until the broken glass pane can be replaced comprising a cover sheet large enough to cover the pane area of a door, said sheet being foldable for easy storage when not being used to cover a door pane area, suspension means extending from the top of the sheet for suspending the sheet from the top of the door, and grasping means extending outwardly from the sides of the sheet for grasping the side edges of the door to spread the sheet laterally and hold it temporarily in place against the front of the door until the sheet can be fastened to the door, said suspension and grasping means being operable from the front of the door, fastening means extending from the sides of the sheet and held by the grasping means across the rear of the door for fastening said sheet to the door, said sheet being made of polyethylene synthetic plastic, said suspension means being a metal hook having a bight slightly larger than the thickness of an aluminum door front panel which it hooks onto, said fastening means being a series of straps with oppositely extending ends adapted to be wrapped around the door and tied together, said grasping means being attached to said straps, said grasping means being made of non-resilient material bendable into a set position for the grasping of the side edges of the door until the fastening straps can be tied together.

7. An emergency method of covering a door having a broken glass pane with a emergency temporary door cover until the broken glass pane can be replaced, said cover comprising a cover sheet of synthetic plastic large enough to cover the pane area of the door, said sheet being foldable for easy storage when not being used to cover a door pane area, a metal hook extending from the top of the cover sheet and having a bight slightly larger than the thickness of an aluminum door front panel, a series of fastening straps having ends extending from opposite sides of the door cover and adapted to be wrapped around the door and tied together, and wires supported in said straps and bendable into a set position for grasping the side edges of the door so as to spread the cover sheet and position the straps at the rear of the door until the fastening straps can be tied together, the steps comprising taking the emergency door cover from storage, unfolding it, placing the hook over the top of the front door panel of the door so as to suspend the cover sheet from the door, bending the wires around the side edges of the door so as to spread the cover sheet laterally and hold it in place and so as to position the straps at the rear of the door in position for tying, walking from the front of the door to a position at the rear of the door, and tying together the ends of the straps which have been held in position there by the wires.

* * * * *